United States Patent [19]

Nothiger

[11] 3,938,620

[45] Feb. 17, 1976

[54] ROPE CLIMBER

[76] Inventor: Paul J. Nothiger, 2964 Hope, Klamath Falls, Oreg. 97601

[22] Filed: July 19, 1974

[21] Appl. No.: 490,137

[52] U.S. Cl. ..... 182/135

[51] Int. Cl.[2] ..... A62B 1/06

[58] Field of Search ..... 182/134, 135, 136, 5; 188/65.1, 65.4, 65.5

[56] References Cited

UNITED STATES PATENTS

| | | | |
|---|---|---|---|
| 493,391 | 4/1893 | Sturtevant | 182/135 |
| 1,826,263 | 10/1931 | Stephens | 182/5 |
| 3,177,544 | 4/1965 | Murdock | 182/5 |
| 3,814,210 | 6/1974 | Hoffman | 182/135 |

*Primary Examiner*—Reinaldo P. Machado
*Attorney, Agent, or Firm*—Clarence M. Crews

[57] ABSTRACT

This invention relates to a rope climber for use in climbing up or down a taut rope, which climber consists of closely similar handle and pedal units, each comprising pivotally connected members between which the rope passes and by which the rope may be alternatively clamped and released through suitable manipulation of the user. My climber units are characterized by the facts that 1. the unit members can be readily disjoined and reunited and can therefore be applied anywhere along the length of a rope;
2. they do not chew into and multilate the rope, nor do they simply squeeze it, but bind it by sharply kinking and pressing it; and
3. they include rope guides which also serve as stops for limiting relative rocking of the members.

4 Claims, 6 Drawing Figures

ROPE CLIMBER

This invention relates to that class of climbers designed for use in climbing up or down a taut rope, which climbers characteristically consist of generally similar handle and pedal units designed to bear the weight of the user and to be operated in alternation by the user, so that each unit grips the rope to sustain the weight of the user while the other is relaxed and shifted. Climbers of this type have important uses, as for enabling a person to be rescued from a well, cliff, burning building or the like. If the person to be rescued is conscious and is capable of self-help he may use the climber himself—otherwise he may be strapped onto the back of a rescuer capable of using the climber.

The climber is also an attractive and beneficial exercise device, and the use of it can be turned into an interesting competitive game between any number of individuals or team competitors.

Needless to say, less exertion is required for descending than for ascending.

Prior devices of the kind referred to, so far as I am aware, have important shortcomings which it is the purpose of the present invention to overcome.

In some instances the members forming a unit merely grip the rope smoothly, compressing it between them. They are undependable, because they may slide when not intended to. In particular, they may slide when urged to clamping relationship only by their own weight, in which case the unit, because it will fall to the lower end of the rope before the user can put his weight on it, will be useless for purposes of descent.

In other instances the members are formed with sharp teeth which chew into and mutilate the rope, impairing the strength and reliability of the rope.

I overcome both of these drawbacks by providing the opposed members with interdigitally related, rounded fingers or projections which kink the rope smoothly but sharply, while pressing it firmly. With this arrangement the unit will sustain itself on the rope under its own weight, even when springs are provided for lightly opposing automatic clamping. The provision of such springs is desirable because it facilitates descent.

Another drawback of prior devices of this general character is that the opposed members of each unit are permanently connected to one another. Such a unit can only be applied to a rope from an end thereof. Since one rope end will generally be anchored, both units, lacking this feature of separability, will have to be applied at the free end, and may have to be worked along a great length of the rope preparatory to actual use.

I overcome this drawback by making the members separable but capable of being quickly and dependably united with the rope and with one another anywhere along the rope, with freedom for limited relative oscillatory movement when so united.

A further feature of my invention resides in the provision of a rope guide affixed to one of the members in a position to stand across the rocking path of the other member, thereby to limit relative separation of the rope gripping portions of said members.

Other objects and advantages will hereinafter appear.

In the drawing forming part of this specification,

Figure 1:
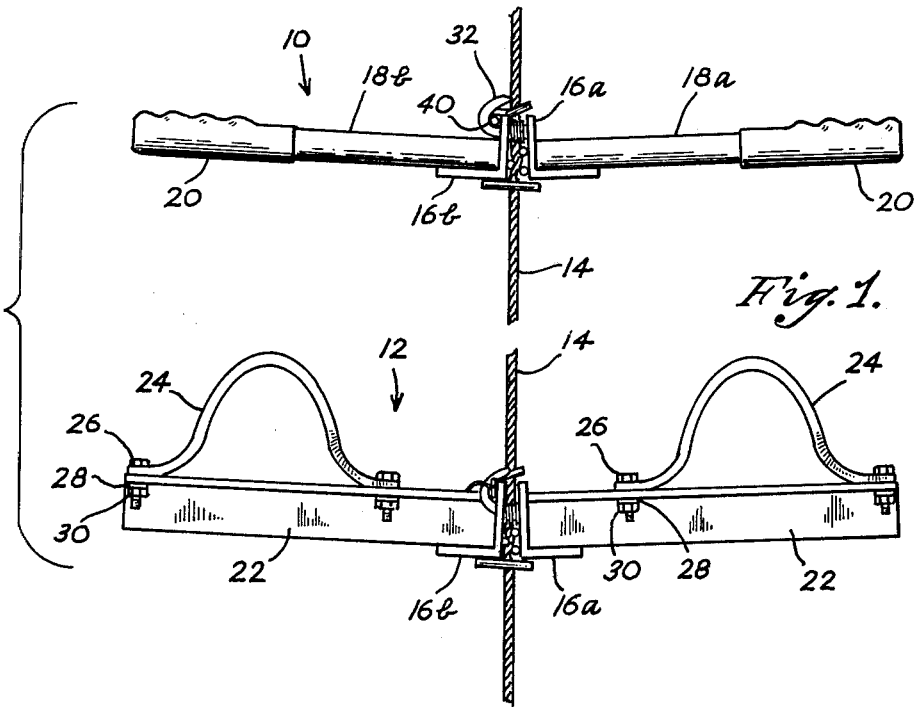
FIG. 1 shows in elevation fully assembled handle and pedal climber units applied in clamping condition on a fragment of rope, the rope being broken away intermediate its ends for compactness of illustration.
Figure 2:
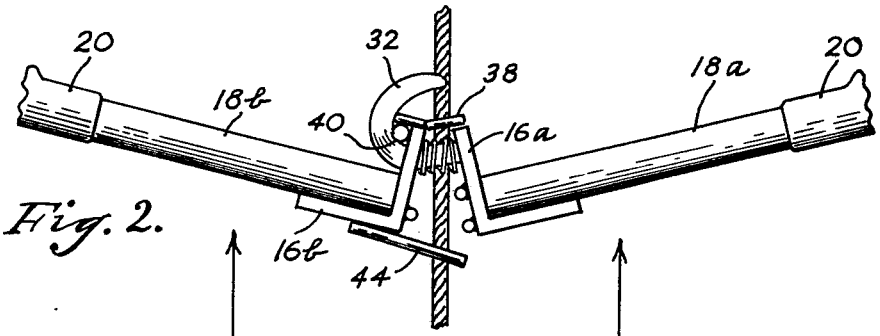
FIG. 2 shows in elevation on a larger scale than FIG. 1 the handle unit in relaxed or non-clamping condition.
Figure 3:
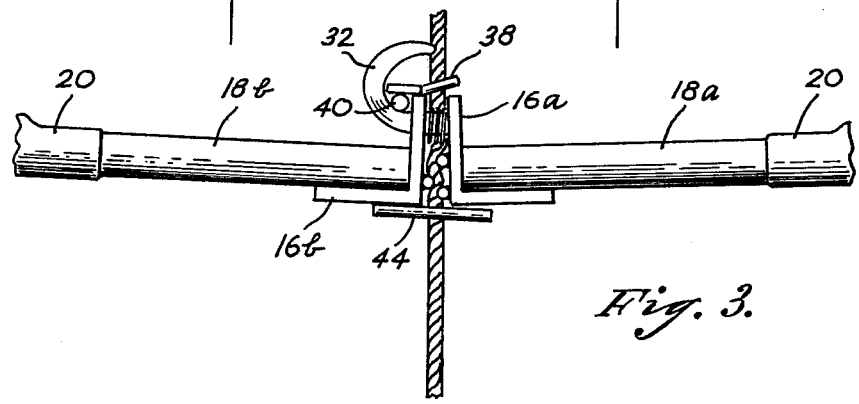
FIG. 3 is like FIG. 2 but shows the handle unit in clamping condition.
Figure 4:
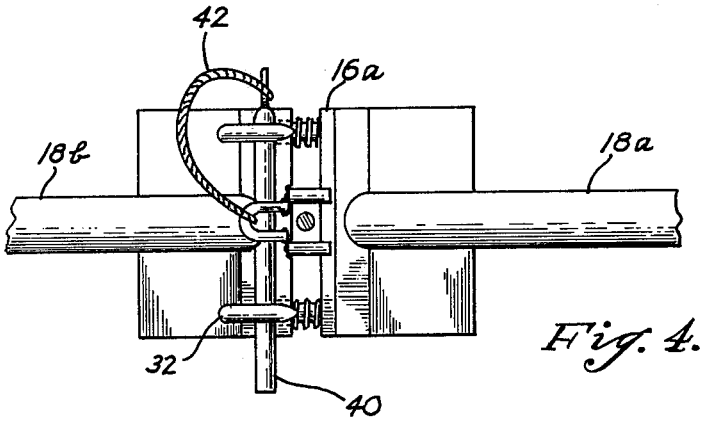
FIG. 4 is a fragmentary, plan view of the applied handle unit.
Figure 5:
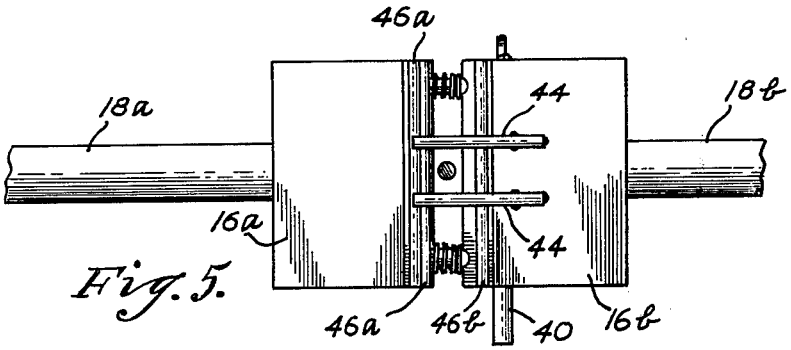
FIG. 5 is a fragmentary, bottom plan view of the applied handle unit.

In FIGS. 1 and 2 an upper handle unit 10 and a lower pedal unit 12 are shown applied in rope clamping condition on a common rope 14.

The upper or handle unit 10 and the lower or pedal unit 12 may be, in all particulars having relation to the rope, exact duplicates of one another. The features in which they differ will be first pointed out and the upper handle member will then be described in detail with the understanding that the latter description can be in all respects applicable to the lower pedal members as well.

The handle unit 10 comprises angle bars **16*a* and 16*b* to the flanges or webs of which outwardly extending tubular arms 18*a* and 18*b* are welded. Molded hand grips 20 of suitable plastic are fixed on the ends of the arms 18**.

The lower pedal unit 12 similarly comprises angle bars **16*a*, 16*b*, but to the flanges of these angle bars webs of outwardly extending angle bar arms 22 are welded. On the upper faces of the outer ends of arms 22, looped shoe receiving straps 24 are secured by suitable fastening means such as bolts 26, lock washers 28 and nuts 30**.

With the exception of the differences already noted, the handle and pedal units may be exact duplicates of one another so that a detail showing and description of the handle members will suffice for both.

Figure 6:
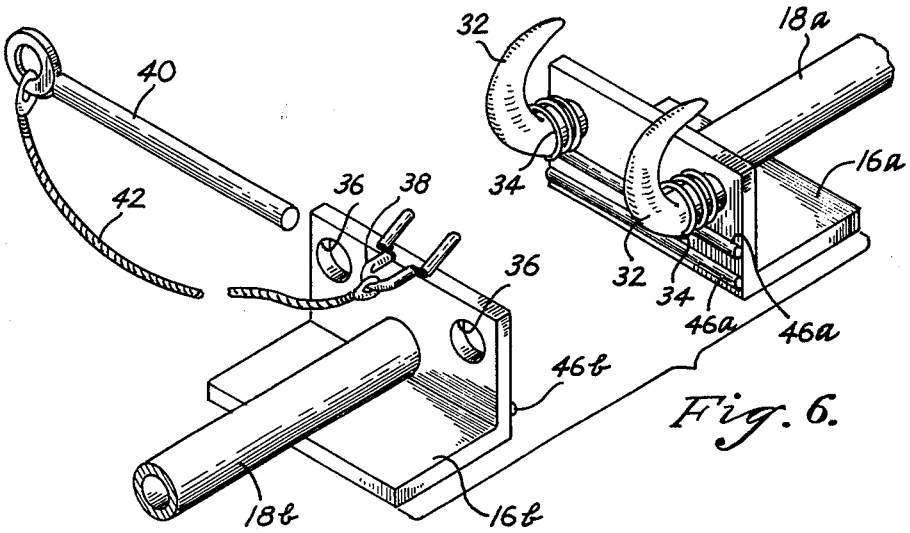
FIG. 6 is a fragmentary, perspective view of the unconnected members of the handle unit.

As best seen in FIG. 6, the upstanding web of the angle bar **16*a* has unitary with it a pair of identical horns 32. Each horn extends horizontally for a short distance, then curves upward through an arc, as shown about 180° in extent. The horns may taper towards their ends as illustrated, and they are surrounded at their bases by light coil springs 34**.

The upstanding web of the opposed angle bar **16*b* has circular holes 36 formed in it at the spacing and height of the horn bases and of a size comfortably to receive the bases of the horns 32. The horns 32, with the springs 34 on their bases, are inserted through the holes 36 until the vertical webs of the angle bars come substantially face to face. The spring coils 34 are of too large diameters to enter the holes 36**.

The vertical web of angle bar **16*a* has affixed to its upper surface, as by welding, a staple-like member 38 whose loop portion extends to the left in FIG. 6 and whose legs extend to the right in overlapping relation to the vertical web of angle bar 16*b***, to serve both as rope guiding means and as flexure limiting stops.

A keeper rod 40 is connected to the loop portion of member 38 by a short piece of tether rope 42. As best seen in FIGS. 1, 2, 3 and 4, the keeper rod 40 is inserted in the space bounded by the upper margin of the vertical web of angle bar **16*b*, lower end portions of the horns 32, and the loop portion of member 38**.

The handle unit 10 can be applied to the rope 14 at any desired point by placing the member **16*a* in confronting relation to the rope passing the horns of 16*b* through the holes of 16*a*, and inserting the keeper rod 40** in place.

The member 16*a* has affixed to its lower face, as by welding, a pair of spaced pins 44 which span the gap between 16*a* and 16*b* and serve as rope confining guides.

The confronting faces of 16*a* and 16*b* are provided with smooth, rounded, horizontally extending, interdigitally related projections which serve to kink the rope sharply enough to bind it securely without biting or cutting into it. As shown there are one spaced projection 46*a* on 16*a* and two such projections 46*b* on 16*b*. These projections could, of course, be increased in number if desired, by increasing the vertical extent of the angle bars 16*a* and 16*b*.

I have described what I believe to be the best embodiment of my invention. What I desire to cover by letters patent, however, is set forth in the appended claims.

I claim:

1. A rope climbing device consisting of complementary pedal and handle units, each unit consisting of two connected, relatively rockable members, adapted to be manually rocked together to grip the rope and apart to release the rope, said members having confronting faces formed with interdigitally arranged, horizontally disposed, smoothly rounded projections cooperative to kink the rope sharply in opposite directions and thereby to bind it smoothly but firmly and dependably against slipping, the confronting portions of opposed rockable members being substantially coterminous at their upper ends, and one of them being equipped at its upper end with spaced rope guiding devices which span the space between the confronting portions and serve also as stops for intercepting the other member, to limit rocking separation of such members.

2. A rope climbing device consisting of complementary pedal and handle units, each unit consisting of two connected, relatively rockable members, adapted to be manually rocked together to grip the rope and apart to release the rope, said members having confronting faces formed with interdigitally arranged, horizontally disposed, smoothly rounded projections cooperative to kink the rope sharply in opposite directions and thereby to bind it smoothly but firmly and dependably against slipping, the confronting ends of opposed members taking the form of upright plates, one of said plates having a plurality of horns which project horizontally through correspondingly spaced openings of the other plate and then curve upward, said other plate having an outward stop projection above said openings, and a keeper pin inserted beneath said stop projection and over lower portions of said horns for limiting relative rocking of said members and thereby preventing separation of them.

3. A rope climbing device as set forth in claim 2 in which a tether connection is provided between the keeper pin and said other plate.

4. A rope climbing device as set forth in claim 3 in which compression coil springs surround the horns between the rope gripping plates for facilitating descent of the rope by the user, the springs being light enough in their action, however, to permit the device to grip the rope dependably under its own weight alone.

* * * * *